US007998286B2

(12) United States Patent
Wiest et al.

(10) Patent No.: US 7,998,286 B2
(45) Date of Patent: Aug. 16, 2011

(54) HIGH CORROSION RESISTANT ZR-TI BASED METALLIC GLASSES

(75) Inventors: Aaron Wiest, Los Angeles, CA (US); Marios D. Demetriou, Los Angeles, CA (US); William L. Johnson, Pasadena, CA (US); Nikolaj Wolfson, Santa Monica, CA (US)

(73) Assignee: California Institute of Technology, Pasadena, CA (US)

( * ) Notice: Subject to any disclaimer, the term of this patent is extended or adjusted under 35 U.S.C. 154(b) by 434 days.

(21) Appl. No.: 12/141,706

(22) Filed: Jun. 18, 2008

(65) Prior Publication Data

US 2009/0014096 A1 Jan. 15, 2009

Related U.S. Application Data

(60) Provisional application No. 60/936,042, filed on Jun. 18, 2007.

(51) Int. Cl.
*C22C 45/10* (2006.01)

(52) U.S. Cl. ..... 148/403; 148/421; 420/422

(58) Field of Classification Search ..... 148/403
See application file for complete search history.

(56) References Cited

U.S. PATENT DOCUMENTS

| | | | | |
|---|---|---|---|---|
| 4,050,931 | A * | 9/1977 | Tanner et al. | 148/403 |
| 5,288,344 | A * | 2/1994 | Peker et al. | 148/403 |
| 7,008,490 | B2 * | 3/2006 | Peker | 148/561 |
| 2006/0231169 | A1 * | 10/2006 | Park et al. | 148/403 |

OTHER PUBLICATIONS

Johnson, "Bulk Glass-Forming Metallic Alloys: Science and Technology", MRS Bulletin, Oct. 1999, pp. 42-56.
Geurtsen, "Biocompatibility of Dental Casting Alloys", Crit Rev Oral Biol Med, 2002, vol. 13, No. 1, pp. 71-84.
Greer et al., "Bulk Metallic Glasses: At the Cutting Edge of Metals Research", MRS Bulletin, Aug. 2007, vol. 32, pp. 611-619.
Hiromoto et al., "Effect of chloride ion on the anodic polarization behavior of the $Zr_{65}Al_{7.5}Ni_{10}Cu_{17.5}$ amorphous alloy in phosphate buffered solution", Corrosion Science, 2000, vol. 42, pp. 1651-1660.
Hiromoto, "Effect of pH on the polarization behavior of $Zr_{65}Al_{7.5}Ni_{10}Cu_{17.5}$ amorphous alloy in a phosphate-buffered solution", Corrosion Science, 2000, vol. 42, pp. 2193-2200.
Inoue, "Stabilization of Metallic Supercooled Liquid and Bulk Amorphous Alloys", Acta mater., 2000, vol. 48, pp. 279-306.

(Continued)

*Primary Examiner* — George Wyszomierski
(74) *Attorney, Agent, or Firm* — Kauth, Pomeroy, Peck & Bailey LLP

(57) ABSTRACT

Bulk solidifying amorphous alloys (BMGs) having improved corrosion resistance properties; and more particularly a subset of Zr—Ti-based BMGs having improved corrosion resistance properties are provided. The BMG compositions are formed by carefully controlling the concentration of, or removing altogether, highly electronegative elements, such as Ni and Cu from Zr—Ti-based bulk solidifying amorphous alloys thereby producing BMG materials with corrosion resistance properties that far exceed those of current commercially available BMGs and most conventional alloys. The elimination of these electronegative materials also opens the possibility of new uses for BMGs, including in biological applications.

23 Claims, 10 Drawing Sheets

OTHER PUBLICATIONS

Wang et al., "Fatigue behavior and fracture morphology of $Zr_{50}Al_{10}Cu_{40}$ and $Zr_{50}Al_{10}Cu_{30}Ni_{10}$ bulk-metallic glasses", Intermetallics, 2004, vol. 12, pp. 1219-1227.
Peker et al., "A highly processible metallic glass: $Zr_{41.2}Ti_{13.8}Cu_{12.5}Ni_{10.0}Be_{22.5}$", Appl. Phys. Lett., Oct. 25, 1993, vol. 63, No. 17, pp. 2342-2344.
Burke, "The Corrosion of Metals in Tissues; and an Introduction to Tantalum", The Canadian Medical Association Journal, Aug. 1940, pp. 125-128.
Schroers, "The Superplastic Forming of Bulk Metallic Glasses", JOM, May 2005, pp. 35-39.
Yamamoto et al., "Cytotoxicity evaluation of 43 metal salts using murine fibroblasts and osteoblastic cells", National Research Institute for Metals, Science and Technology Agency, Jun. 16, 1996, pp. 331-340.
Unknown, "Information for Physicians Who Believe They May Have a Patient With a Sensitivity to Metal", Zimmer Technical Specification, 4 pgs., 2005.

* cited by examiner

FIG. 1

| | Stiffness [GPa] | Yield Strength [MPa] | Fatigue Endurance Limit [MPa] | Vickers Hardness [Kg/mm$^2$] | Elasticity |
|---|---|---|---|---|---|
| Stainless Steel | ~200 | 200-1000 | 200-400 | 200-400 | 0.2% |
| Cobalt Alloy | ~230 | 500-1500 | 250-750 | 250-450 | 0.2% |
| Titanium Alloy | ~110 | 450-850 | 300-600 | 250-350 | 0.2% |
| BMGs | ~90 | ~1900 | 90-1000 | ~600 | 2% |

GLASS

CRYSTAL

Alloys placed in 40mL of Hydrochloric Acid 37%

Wear Debris

Stress Shielding

Femoral Nail Failure

FIG. 10

| | Stiffness [GPa] | Yield Strength [MPa] | Fatigue Endurance Limit [MPa] | Vickers Hardness [Kg/mm$^2$] | Elasticity |
|---|---|---|---|---|---|
| Zr-Ti-Be Metallic Glass | ~90 | ~1900 | 90-900 | ~600 | 2% |
| 316L Stainless Steel | ~200 | 200-1000 | 200-400 | 200-400 | 0.2% |
| Co-Cr-Mo | ~230 | 500-1500 | 250-750 | 250-450 | 0.2% |
| Ti Alloys | ~110 | 450-850 | 300-600 | 250-350 | 0.2% |
| Bone | ~20 | ??? | 20-80 | ~70 | 1.0-1.5% |

HIGH CORROSION RESISTANT ZR-TI BASED METALLIC GLASSES

CROSS-REFERENCE TO RELATED APPLICATIONS

The current application claims priority to U.S. Provisional Patent Application No. 60/936,042, filed Jun. 18, 2007, the disclosure of which is incorporated herein by reference.

FIELD OF THE INVENTION

The current invention is directed to metallic glasses with improved corrosion resistance; and more particularly to Zr—Ti-based bulk metallic glasses with improved corrosion resistance properties.

BACKGROUND OF THE INVENTION

As a result of their chemical and structural homogeneity providing a lack of local electrochemically active sites, metallic glasses are characterized by improved corrosion resistance when compared to typical crystalline metals. For example, in a study conducted by Morrison et al., the corrosion resistance of a Zr—Ti-based bulk metallic glass (BMG) in a phosphate-buffered saline solution was compared against that of common crystalline biomaterials and was found to be better than 316L stainless steel and comparable to Ti-6Al-4V and CoCrMo. (See, Morrison, M. L., et al., *Intermetallics,* 12, 1177 (2004), the disclosure of which is incorporated herein by reference.) Most metallic glasses are, therefore, expected to behave well in corrosive environments, and little research has been done to identify whether these corrosive properties can be improved. As a result, BMGs having corrosion resistant properties that meet or exceed the most corrosion resistant conventional materials, such as stainless steels, Ti-alloys, and CoCr-based alloys have not been reported.

In addition, owing to the fact that the compositions of known BMGs have not been optimized for corrosion resistance, many BMG compositions are found to behave poorly in some corrosive environments. BMG compositions generally require the presence of Late Transitions Metals (LTM), either as base metals or as alloying additions. Ni and Cu are in fact the most commonly found LTM's in BMG's, as most of the known BMG compositions contain either Ni or Cu or both. For example, presently one of the most widely available commercial BMGs is a Ni and Cu containing Zr—Ti-based materials sold under the tradename VITRELOY by Liquid-Metal technologies, Inc. (See, e.g., U.S. Pat. No. 5,288,344; and Peker, A. & Johnson, W. L., *Applied Physics Letters,* 63, 2342 (1993), the disclosures of which are incorporated herein by reference.) Aside from being excellent additions to BMG compositions, Ni and Cu are generally acceptable elements in many conventional engineering applications. One of the exceptions could be corrosion. Recognizing that Ni and Cu are highly electronegative, one would expect alloys containing Ni and Cu to perform rather poorly under corrosive environments, particularly in compositions where they are combined with highly electropositive metals such as Zr, Ti, or Be. By these considerations, it is therefore conceivable that combining Zr, Ti and Be with Ni and Cu, as in VITRELOY would result in a BMG alloy whose resistance against certain corrosive reactions would not be as high as one might expect.

Aside from corrosive effects of Ni and Cu alloy additions, the relatively high electronegativity of these elements gives rise to other undesirable effects which could be of great concern in certain applications, such as for instance in biological applications. Specifically, owing to their high etectronegativity, Ni and Cu have the possibility of existing as free radicals in the blood stream. In turn, these free radicals are notorious triggers for severe adverse biological reactions. In consequence, Ni and Cu are widely regarded as non-biocompatible, as they have been associated with severe adverse biological reactions. (See, Geurtsen, W., *Critical Reviews in Oral Biology & Medicine,* 13, 35 (2005), the disclosure of which is incorporated herein by reference.) As a result, the vast majority of the known Zr—Ti-based BMGs compositions cannot qualify as biocompatible and hence their use in biological applications may be limited.

Accordingly, a need exists for a class of Zr—Ti-based BMGs that have improved corrosion resistance properties, and preferably that are Ni and Cu free to ensure good biocompatibility.

SUMMARY OF THE INVENTION

The current invention is directed to Zr—Ti-based bulk metallic glass compositions with improved corrosion resistance.

In another embodiment, the Zr—Ti-based bulk metallic glass compositions are formed using constituents that are more electropositive than Ni or Cu.

In still another embodiment the Zr—Ti-based bulk metallic glass compositions are Ni and Cu free.

In yet another embodiment, the Zr—Ti-based bulk metallic glass compositions would contain at least 60 at % Zr and Ti.

In still yet another embodiment, the Zr—Ti-based bulk metallic glass compositions further contain at least 25 at % of one material selected from the group consisting of Be, Al, Zn, Ta, Co, Fe, Cr, Mo, Nb, Mg, Hf, Y, and V.

In still yet another embodiment, the Zr—Ti-based bulk metallic glass compositions have at least 25 at % Be.

In still yet another embodiment, the Zr—Ti-based bulk metallic glass compositions have an amorphous phase volume fraction of at least 25% by volume.

In still yet another embodiment, the Zr—Ti-based bulk metallic glass compositions are biologically compatible. In such an embodiment the invention is also directed to an implant made using the inventive alloy.

BRIEF DESCRIPTION OF THE DRAWINGS

The description will be more fully understood with reference to the following figures and data graphs, which are presented as exemplary embodiments of the invention and should not be construed as a complete recitation of the scope of the invention, wherein:

FIG. 1 provides a table comparing mechanical properties for BMGs and conventional crystalline alloys;

FIG. 10 provides a table comparing mechanical properties for BMGs, conventional crystalline alloys and bone;

DETAILED DESCRIPTION OF INVENTION

The current invention is directed to bulk solidifying amorphous alloys (BMGs) having improved corrosion resistance properties; and more particularly to a sub-set of Zr—Ti-based BMGs that match the corrosion resistance properties of CoCrMo. Specifically, the current invention has surprisingly found that by carefully controlling the concentration of, or removing altogether, highly electronegative elements, such as Ni and Cu from Zr—Ti-based bulk solidifying amorphous alloys it is possible to produce BMG materials with corrosion resistance properties that far exceed those of current commercially available BMGs and most conventional alloys. Moreover, the invention recognizes that optimization of the BMG composition with respect to these elements opens the possibility of new uses for BMGs, including in biological applications.

Figure 2:
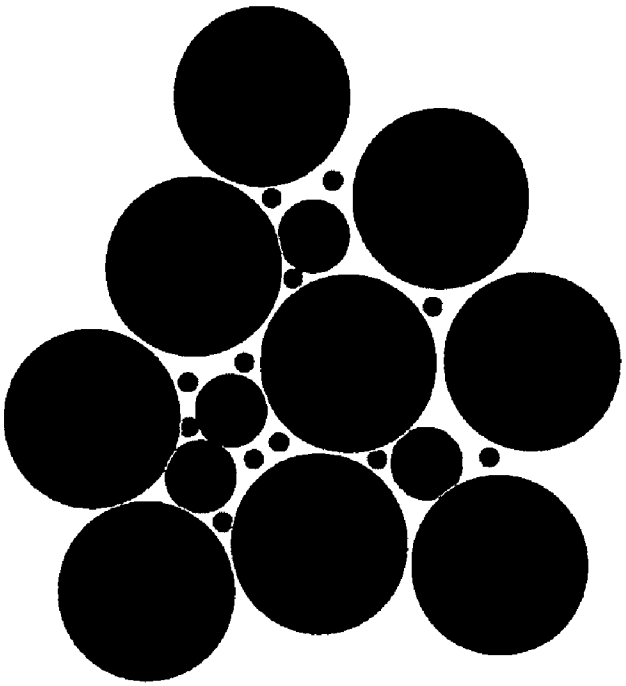
FIG. 2 provides schematic diagrams comparing the atomic structure of BMGs with that of a conventional crystalline alloy.
Figure 2:
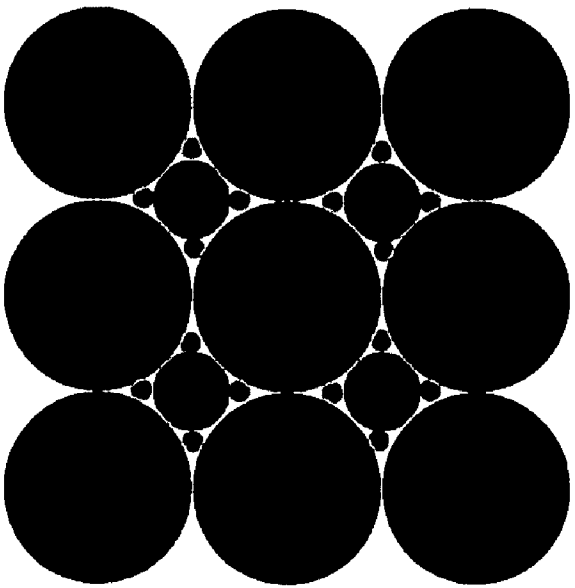

Before exploring the compositions of the current invention, it is important to note that Zr—Ti-based BMGs are well-known in the prior art. (See, e.g., U.S. Pat. No. 5,288,344; Greer, A. L., *MRS Bull.,* 32, 611 (2007); Johnson, W. L., *MRS Bull.,* 24, 42 (1999); and Inoue, A., *Acta. Mater.,* 48, 279 (2000), the disclosures of which are incorporated herein by reference.) These materials are composed of mixtures of elements that frustrate crystallization pathways sufficiently that samples having large dimensions can be cast to form completely amorphous articles. In addition, as summarized in the chart provided in FIG. 1, in comparison with comparable conventional corrosion resistant materials like titanium, stainless steel and cobalt alloys, BMGs are highly elastic materials with high hardness, high strength, and low modulus. Moreover, unlike crystalline materials, which have periodic arrangements of atoms or molecules and therefore have defects that can dramatically weaken the material, glasses have near theoretical properties because the structure is random and microscopic defects are nonexistent, as shown in FIG. 2.

However, because in the past the corrosion resistance properties of BMGs has been considered sufficient to the applications to which these materials have been used, little work has been done to investigate how these properties may be improved. Indeed, thus far the focus of research on BMG alloys has been on how to improve either the mechanical properties or the glass forming properties of the materials. As a result most of the exemplary BMG materials set forth in the prior art, and all of the commercially available BMGs include highly electronegative elements at relatively high atomic fractions, such as, for example, Cu and Ni.

For example, one family of BMGs that are well-known are the Zr—Ti-based BMGs disclosed first by Peker & Johnson in 1993. (Peker, A. & Johnson, W. L., *Applied Physics Letters,* 63, 2342 (1993); and U.S. Pat. No. 5,288,344, the disclosures of which are incorporated herein by reference.) Indeed, because of its exceptional glass forming ability (parts with sections >1 inch thickness can be cast) and good mechanical properties (tensile yield stress of ~1.9 GPa, a Vicker's hardness of ~600 Kg/mm$^2$, an elastic limit of 2%, and a Young's modulus of ~90 GPa), one of most commercially successful BMGs is a Zr—Ti-based BMG having a composition of $Zr_{62.6}Ti_{11.0}Cu_{13.2}Ni_{9.8}$ $Be_{3.4}$ (weight percent). This material is sold commercially as Vitreloy1 by LiquidMetal Technologies, Inc. This alloy will be referred to as LM1 herein out. The disadvantage of LM1 and most other commercially available Zr—Ti-based BMGs is that they contain both Ni and Cu, which are materials that have a strong tendency to leech and form metallic salts under highly corrosive environments. In addition, the metallic salts formed from Ni and Cu are highly cytotoxic, limiting their usefulness in biological environments. (See, Yamamoto, A., et al., *J. Biomed. Mater. Res.,* 39, 331 (1998), the disclosure of which is incorporated herein by reference.)

The current invention reports the surprising discovery that by limiting the concentrations of, or where possible eliminating altogether, elements with a certain threshold level of electronegativity it is possible to obtain Zr—Ti-based BMGs with dramatically improved corrosion properties. More specifically, the invention proposes that the corrosion resistance of BMG alloys can be substantially predicted based on the following electronegativity series, which incorporates common constituents of Zr—T-based BMGs (note the higher the number the greater the electronegativity of the material):

Electronegativity Series (Ni=1.91)<(Cu=1.901<(Co=1.88)<(Fe=1.831<(Cr=1.66)<(Be=1.57)<(Ti=1.541<(Zr=1.33)

Specifically, it is proposed that Zr—Ti BMGs containing only Be or small concentrations of Cr, Fe or Co, but that do not contain Ni or Cu will show improved corrosion resistance. Although not to be bound by theory, it is believed that the reason for this general correspondence between the electronegativity of individual components of the alloy and the overall corrosion resistance of the alloy is based on the increased ionic reactions these highly electronegative species initiate when placed into highly corrosive environments, such as, for example, in the body. (For a more detailed discussion of the corrosion of metals in general and more specifically in the body, see Burke, G. L., Canadian Med. Assoc. Journal, August, 125 (19401; Hiromoto, S., et al., Corrosion Science, 40, 2193 (2000) and Hiromoto, S., et al., Corrosion Science, 40, 1651 (2000), the disclosures of which are incorporated herein by reference.) Regardless of the mechanism by which the novel compositions gain these improved corrosion resistance properties, the corrosion resistant alloys in accordance with one embodiment of the current invention are constituted in relation to the following molecular formula:

$$(Zr_aTi_b)_{1-z}(Be_cX_{1-c})_z$$

Wherein:

X is selected from at least one of the following additive elements: Y, Co, Fe, Cr, Mo, Mg, Al, Hf, Ta, Nb and V;

C is at least 25 at %;

Z is from 20 to 50 at %;

Preferably the ratio a to b is around 1.16; and

Elements having electronegativity greater than 1.9 are present only in trace amounts (from 0 to 2 at % of the total alloy composition).

Table 1 provides a list of some exemplary amorphous alloys that have been tested for their chloride corrosion resistance properties. Although these materials are suitable embodiments, it should be understood that they are only meant to be exemplary and that the invention should not be confined to the specific alloys listed below.

TABLE 1

Exemplary Corrosion Resistant BMGs

| Atomic Percent | Weight Percent |
|---|---|
| $Zr_{35}Ti_{30}Be_{35}$ | |
| $Zr_{25}Ti_{40}Be_{30}Cr_5$ | $Zr_{48.3}Ti_{40.5}Be_{5.7}Cr_{5.5}$ |
| $Zr_{35}Ti_{30}Be_{33}Fe_2$ | $Zr_{63.4}Ti_{28.5}Be_{5.9}Fe_{2.2}$ |
| $Zr_{35}Ti_{30}Be_{31}Fe_4$ | |
| $Zr_{35}Ti_{30}Be_{29}Fe_6$ | $Zr_{61.1}Ti_{27.5}Be_5Fe_{6.4}$ |
| $Zr_{35}Ti_{30}Be_{27.5}Fe_{7.5}$ | |
| $Zr_{35}Ti_{30}Be_{33}Co_2$ | $Zr_{63.3}Ti_{28.5}Be_{5.9}Co_{2.3}$ |
| $Zr_{35}Ti_{30}Be_{31}Co_4$ | |
| $Zr_{35}Ti_{30}Be_{29}Co_6$ | $Zr_{60.9}Ti_{27.4}Be_5Co_{6.7}$ |
| $Zr_{35}Ti_{30}Be_{27.5}Co_{7.5}$ | |

Figure 3:
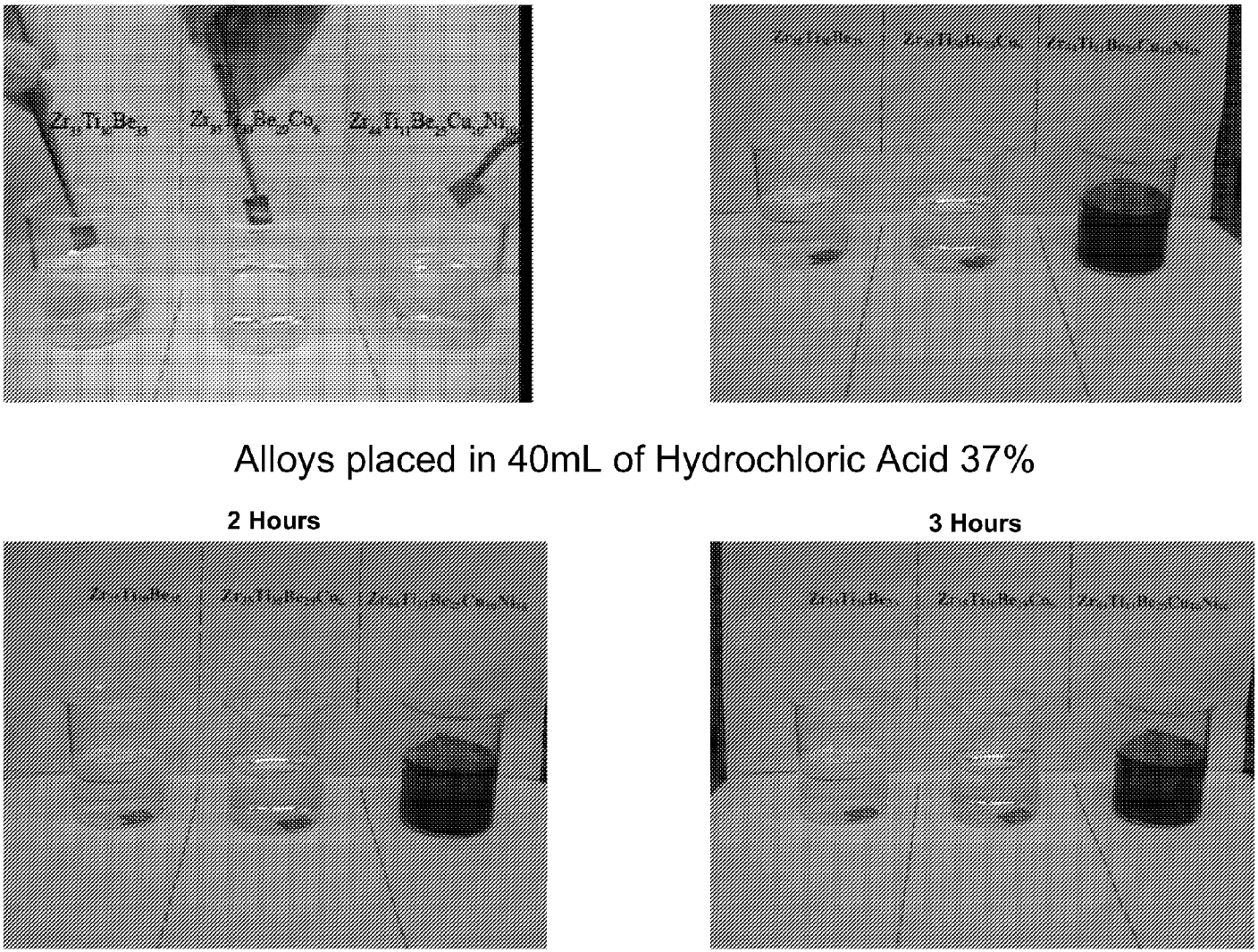
FIG. 3 provides a photographic series showing the results of corrosion tests on a conventional BMG and exemplary BMGs in accordance with the current invention.

As a simple visual test of the improved corrosion resistance properties of the current invention, clean 3 mm square samples of a conventional Cu/Ni containing BMG ($Zr_{44}Ti_{11}Be_{25}Cu_{10}Ni_{10}$) and two improved alloys in accordance with the current invention ($Zr_{35}Ti_{30}Be_{35}$ and $Zr_{35}Ti_{30}Be_{29}Co_6$) were placed into a 37% solution of hydrochloric acid (HCl). FIG. 3 provides time-lapse photography of the samples over a 3 hour period. As shown, the results are visually quiet dramatic as the Cu/Ni containing BMG undergoes substantial corrosion while the alloys of the instant invention show little to no degradation.

Figure 4A:
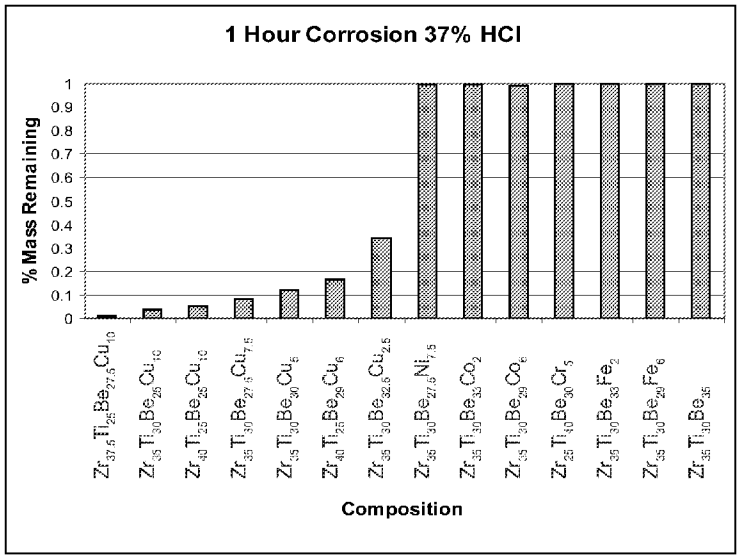
FIGS. 4*a* to 4*c* provide a series of data graph showing the quantitative results of corrosion tests on conventional BMGs and exemplary BMGs in accordance with the current invention.
Figure 4B:
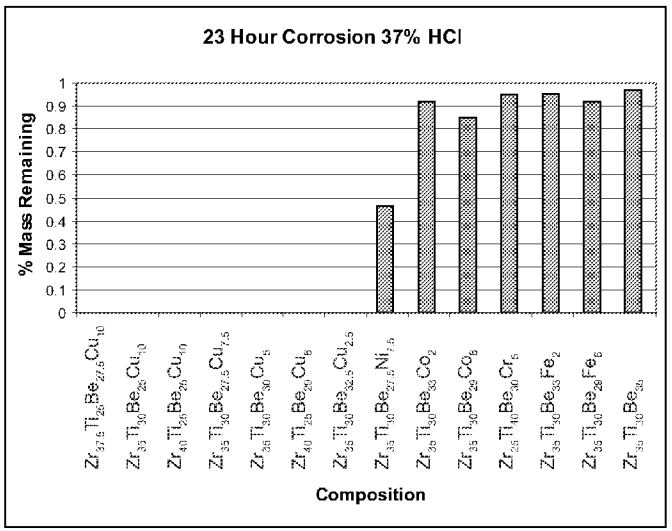
Figure 4C:
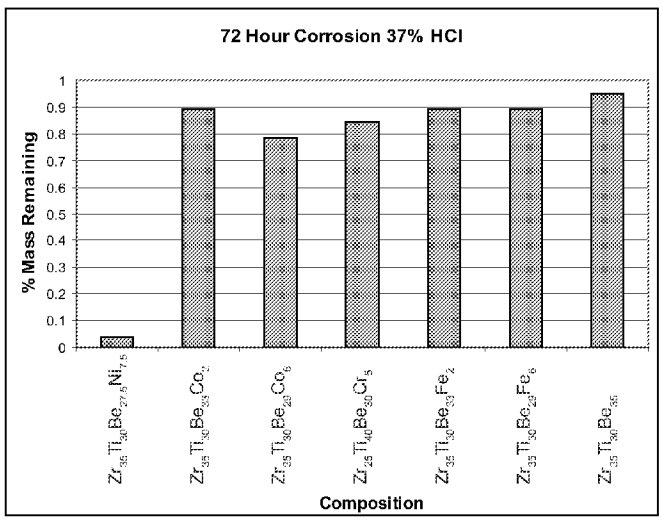

Quantitative analysis of these experiments over a 72-hour period confirmed the visual results. Data graphs plotting the percent mass lost as the result of exposure to the HCl solution are provided in FIGS. 4*a* to 4*c*. These quantitative results also confirm the ranking of the preferred corrosion resistant materials discussed above. Specifically, while all of the improved alloys of the current invention show vastly improved corrosion resistance properties, even over BMGs with only one of either a Ni or Cu constituent, the Be only containing alloy was superior to all of the BMGs tested, and among the other alloys the Fe and Cr containing BMGs were superior to the Co containing BMG. Accordingly, it is submitted that other potential additives may be evaluated for possible corrosion inducing properties based on their electronegativity relative to the constituents tested herein.

Finally, tests were performed to see if the corrosion found in conventional Ni/Cu containing BMGs was limited to the leaching of the electronegative constituents. To accomplish this an HCl test, as described above, was performed on a sample of a commercially available Cu/Ni containing BMG sold by under the name VITRELOY® 1b, sold by Liquid-Metal, Technologies, Inc. During the test samples were drawn and analyzed to see what materials were leaching into solution with the acid. Table 2, below, provides data from this experiment. In summary, it was not the case that Cu and Ni were the only constituents of the alloy that leached into solution. In fact the alloy released concentrations of all of its constituent elements. In fact, surprisingly it was Zr that accounted for the highest concentration of solubilized material suggesting that the presence of these electronegative elements has a tendency to compromise the integrity of the alloy as a whole when placed in a highly corrosive environment.

TABLE 2

Quantitative HCl Corrosion Test on VITRELOY ® 1b

| Element | 30 s | 120 s | 240 s | 300 s |
|---|---|---|---|---|
| Be | 0.12 | 3.3 | 11.5 | 75 |
| Ti | 0.32 | 8 | 29 | 230 |
| Zr | 2.3 | 145 | 550 | 4150 |
| Ni | 0.12 | 10 | 34.5 | 180 |
| Cu | xxx | 12.5 | 40 | 195 |

(All units in ppm)

Figure 5A:
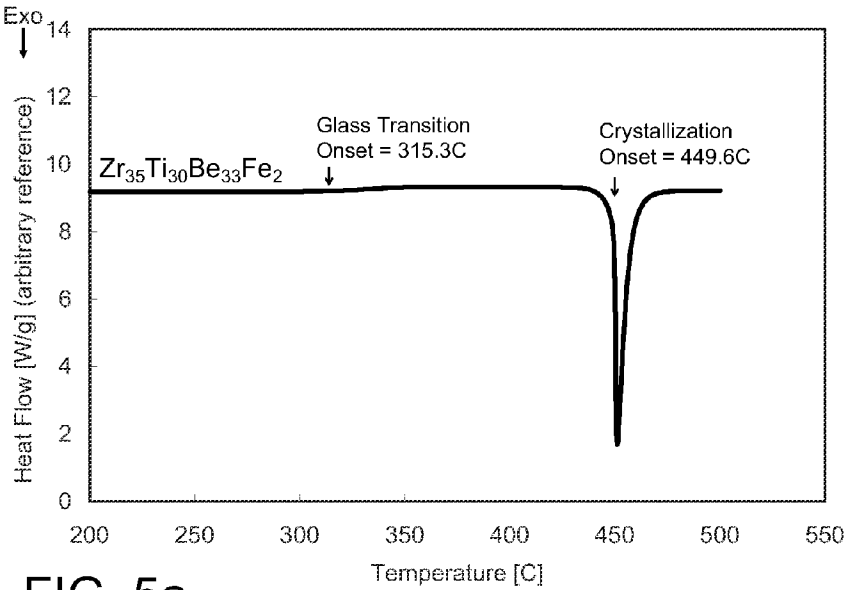
FIGS. 5*a* and 5*b* provide differential calorimetry data and an x-ray diffractogram for a $Zr_{35}Ti_{30}Fe_2Be_{33}$ composition in accordance with the current invention.
Figure 5B:
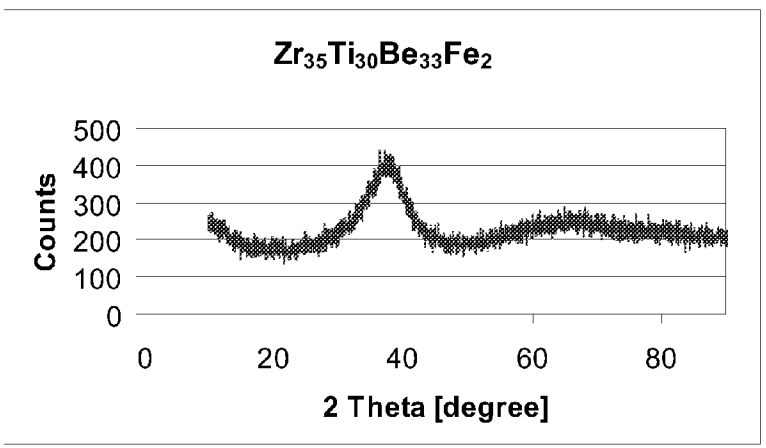
Figure 6A:
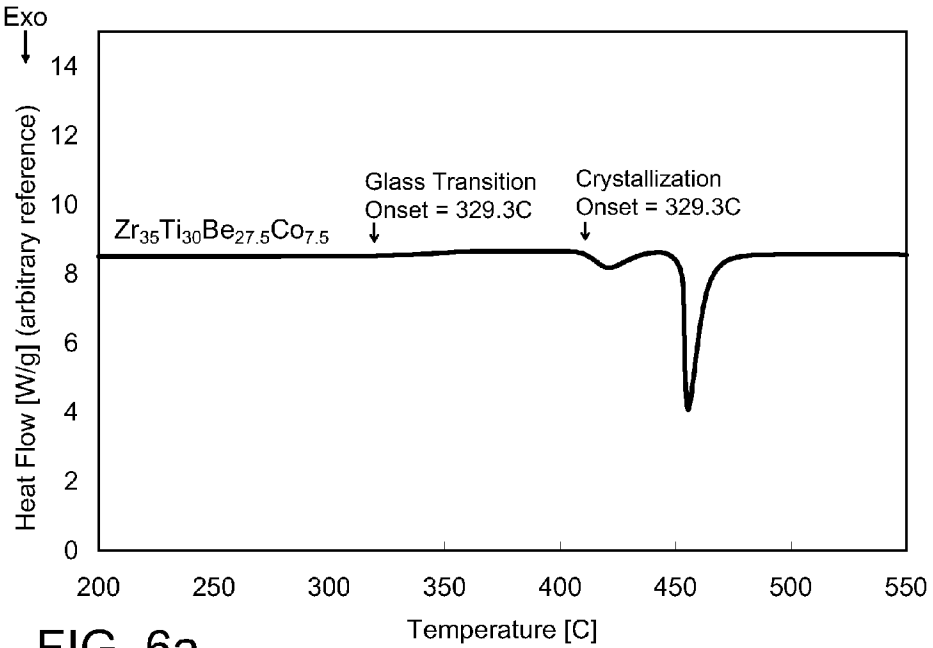
FIGS. 6*a* and 6*b* provide differential calorimetry data and an x-ray diffractogram for a $Zr_{35}Ti_{30}Co_{7.5}$ $Be_{27.5}$ composition in accordance with the current invention.
Figure 6B:
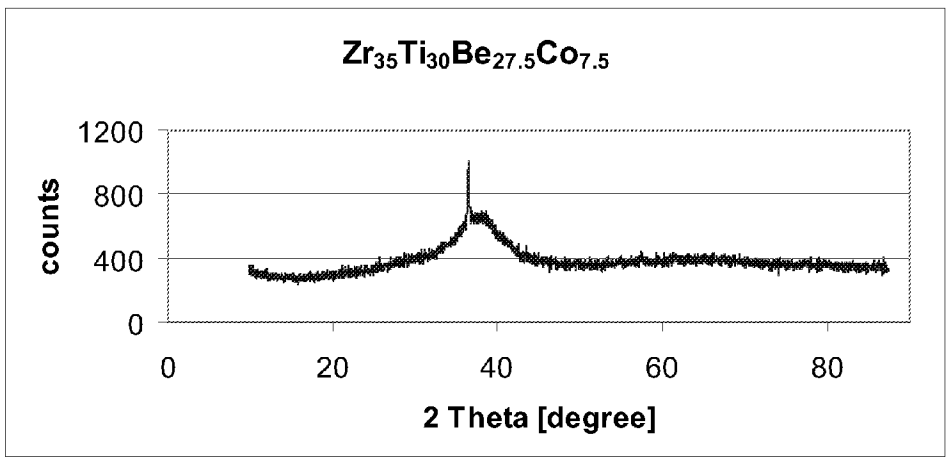

Data was also collected on a selection of the above materials to determine whether the elimination of the highly electronegative elements Ni and Cu had a detrimental impact on the glass forming ability of the inventive alloys. FIGS. 5 and 6 shown differential calorimetry scans and x-ray diffractograms for $Zr_{35}Ti_{30}Be_{33}Fe_2$ and $Zr_{35}Ti_{30}Be_{27.5}Co_{7.5}$, respectively. As shown, these data plots verify that both these exemplary alloys maintain amorphous characteristics. For the purposes of this disclosure an amorphous character means that at least 25% of the alloy by volume is formed with an amorphous phase.

Figure 7:
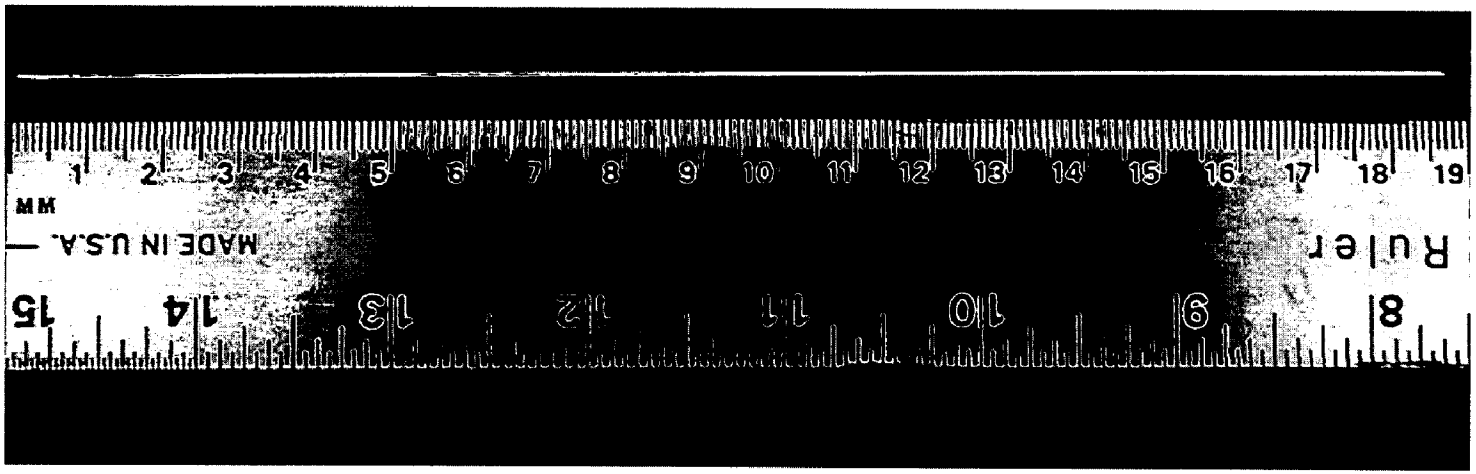
FIG. 7 provides a photograph of an amorphous wire formed from a $Zr_{35}Ti_{30}Co_6$ $Be_{29}$ composition in accordance with the current invention.

Owing to the viscous characteristics of the supercooled liquid state and due to the lack of solidification shrinkage, BMGs are known to exhibit net-shape forming and microforming capabilities superior to those of conventional crystalline metals. (Schroers, J., JOM—J. Min. Met. Mat. S. 57/5, 35 (20051, the disclosure of which is incorporated herein by reference.) This superior forming ability allows for dramatic cost savings in manufacturing complex articles. Accordingly, tests were conducted to determine whether these net-shaping properties of the corrosion resistant BMGs of the current invention could be exploited to fabricate components. To this end, an amorphous wire was formed with an inventive $Zr_{35}Ti_{30}Be_{29}Co_6$ BMG alloy. A single step processing technique was used whereby the wire was formed by fusing two quartz tubes together, one having an inner diameter (ID) of 1 cm and the other having an ID of 1.25 mm. During the process the alloy was melted in the 1 cm ID tube at 950° C. under vacuum and applying an atm of pressure using argon and water quenching. As shown in the photographic plate provided in FIG. 7, a net-shape wire was formed from the alloy with no further processing steps being required indicating that the alloys of the current invention maintain the net-shape processing characteristics of conventional Cu/Ni containing BMGs.

Accordingly, the compositions of the current invention provide Zr—Ti-based BMGs with improved corrosion resistance and comparable mechanical and glass forming properties.

EXAMPLES

The above description will be understood more fully in reference to the following exemplary application of the inventive material. It should be understood that the examples that follow are only meant to provide context to the invention and the invention should not be viewed as limited to the scope expressed therein.

Example 1

Corrosion Resistance Testing

Although the results discussed with reference to FIGS. 3 and 4 provide ample evidence of the superior corrosion resistance properties of the inventive BMGs in comparison to conventional BMGs, tests were also conducted to compare the corrosion resistance of the inventive materials as compared to other conventional alloys that are typically used in highly corrosive environments over a long time period.

The materials tested are listed in Table 3, below. It should be understood that while the discussion of these results will refer to the common names of these materials that there is actually significant variation in composition. (See, e.g., Zimmer Technical Specification, "Information for Physicians Who Believe They May Have a Patient With a Sensitivity to Metal", the disclosure of which is incorporated herein by reference.)

TABLE 3

Compositions Tested in Long-Term Corrosion Test

| Common Name | Composition |
|---|---|
| 316L Stainless Steel | $Fe_{62}Cr_{18}Ni_{15}Mo_3Mn_2$ |
| Co—Cr—Mo | $Co_{65}Cr_{29}Mo_6$ |
| Titanium Alloy | $Ti_{90}Al_6V_4$ |
| Conventional Metallic Glasses | $Zr_{67}Ti_9Be_4Cu_{11}Ni_{10}$ |
| Inventive Materials | $Zr_{61}Ti_{27}Be_5Co_7$ |
| | $Zr_{65}Ti_{29}Be_6$ |

All of the materials tested were subjected to the same sample preparation and test conditions. Specifically, all of the metallic glasses were formed in a conventional quench casting manner using >99% pure elements that were melted, cast and cut. The surfaces of the samples were polished to a 3 μm surface finish. The amorphous nature of the alloys was then verified using a standard technique, as previously described. The conventional alloys were obtained from pre-manufactured parts and their surfaces also polished to a 3 μm surface finish. Once the materials were prepared the alloys were exposed to four different corrosive solutions for a periods of 1 and 3 months and then tested. The solutions tested were:

0.6 Molar NaCl (Ocean Water);

10×PBS;

37% HCl; and

50% NaOH.

The results depended on the solution and exposure length. For example, there was no evidence of corrosion of any materials tested in the 0.6M NaCl or 10×PBS solutions. In NaOH a slight difference is seen between the materials after 3 months in solution, as shown in Table 4, below. In summary the corrosion resistance series is: 316L Stainless Steel>ZrTiBe=CoCrMo=ZrTiBeCo>Ti64>Vit1.

Figure 8:
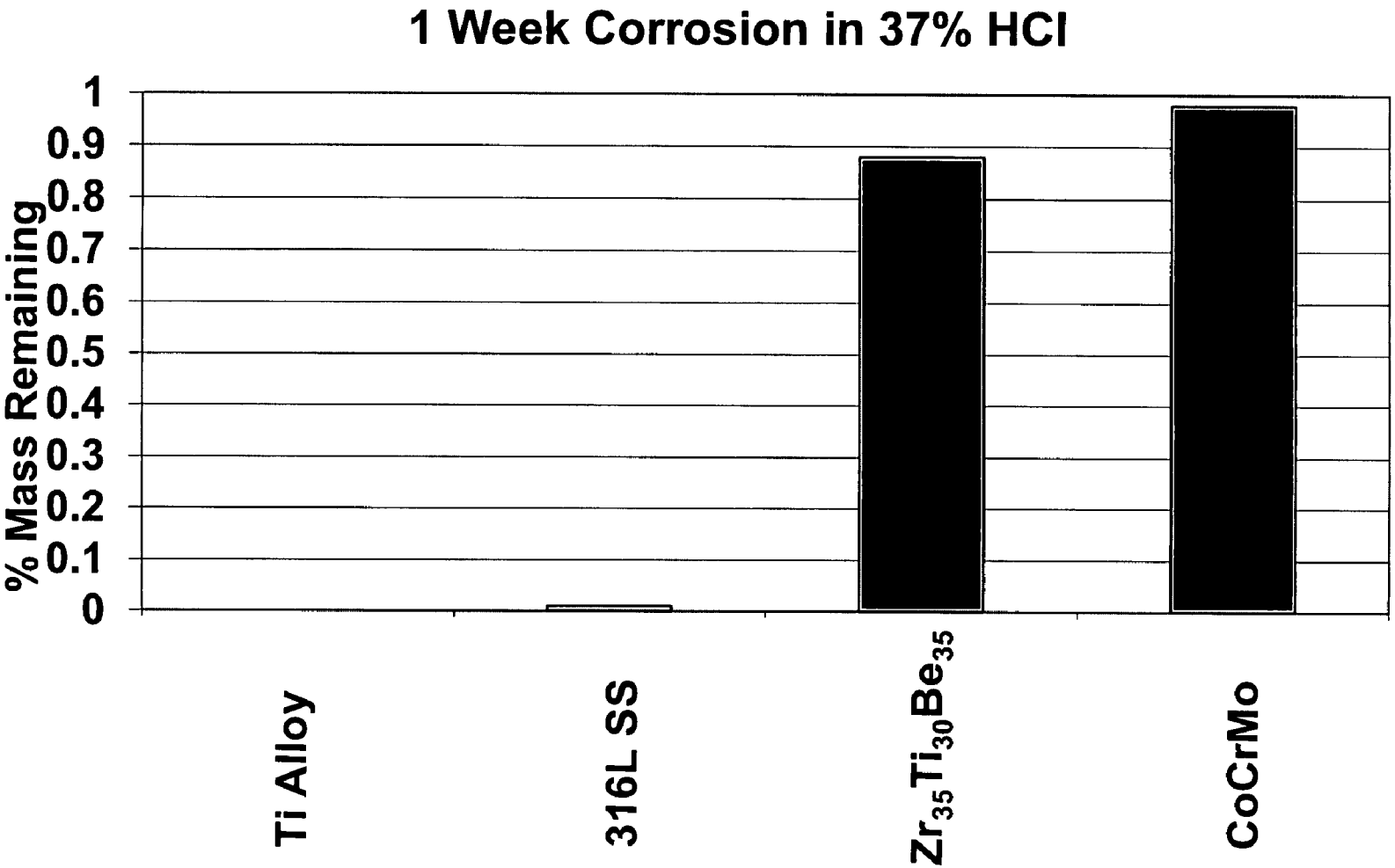
FIG. 8 provides a data graph showing the quantitative results of comparison corrosion tests for exemplary inventive BMGs and conventional materials.

However, the HCl test shows dramatic results. Corrosion differences are visible in as little as 1 week, the results of which are summarized in the graph provided in FIG. 8. The conventional BMG material is not shown because it degraded completely long before the conclusion of the test. However, quantitative mass loss results including the conventional BMG material is summarized in Table 5, below.

TABLE 5

Mass Loss Data for 1 Week HCl Corrosion Test

| | Material: | | | |
|---|---|---|---|---|
| | Stainless steel | ZrTiBe | ZrTiBeCo | ZrTiBeNiCu |
| Mass Loss (%) | 99% | 11.6% | 100% | 100% |

In summary, based on these results the long-term corrosion resistance of these materials would be ranked in order of superior properties as CoCrMo>ZrTiBe>316LSS>Ti alloy>Vit1b. Moreover, using mass spectroscopy to examine the constituents dissolved from the ZrTiBe material indicates that no element is preferentially dissolved. These results are summarized in Table 6, below.

TABLE 6

MS Data for ZrTiBe

| Element | Weight Percent | Dissolved in HCl | Composition in Sol. |
|---|---|---|---|
| Zr (35 at %) | 65% | 235 ppm | 78% |
| Ti (30 at %) | 29% | 50 ppm | 17% |
| Be (35 at %) | 6% | 17 ppm | 6% |

To summarize, the corrosion tests provide the following conclusions:

Corrosion in 0.6M NaCl (⅓ month studies): no evidence of mass loss in any samples (Elements below detection limit of ICP-M).

Corrosion in 10×PBS (⅓ month studies): no evidence of mass loss in any samples (Elements below detection limit of ICP-M)

Corrosion in 50% NaOH (⅓ month studies): no evidence of mass loss in any samples (Elements below detection limit of ICP-M) for one month study. Three month study provides the following results:

ZrTiBe—(0.10% dissolved)

ZrTiBeCo—(0.10% dissolved)

TABLE 4

Quantitative Analysis of Long-Term Corrosion Study

| | Alloy Material | | | | | | | | | | | |
|---|---|---|---|---|---|---|---|---|---|---|---|---|
| Solution | ZrTiBe | | ZrTiBeCo | | ZrTiBeNiCu | | 316LSS | | Ti64 | | CoCrMo | |
| 10X PBS 1 mo | <50 ppb | | <50 ppb | | <50 ppb | | <50 ppb | | <50 ppb | | <50 ppb | |
| NaCl 3 mo | <50 ppb | | <50 ppb | | <50 ppb | | <50 ppb | Ti | 80 ppb | | <50 ppb | |
| | | | | | | | | Al | <50 ppb | | | |
| | | | | | | | | V | <50 ppb | | | |
| NaOH 3 mo | Zr | 1.2 ppm | Zr | 1.7 ppm | Zr | 15.7 ppm | <50 ppb | Ti | 270 ppb | Co | 105 ppb | |
| | Ti | 285 ppb | Ti | 260 ppb | Ti | 330 ppb | | Al | <50 ppb | Cr | 115 ppb | |
| | Be | 75 ppb | Be | 60 ppb | Be | 395 ppb | | V | <50 ppb | Mo | 190 ppb | |
| | | | Co | 100 ppb | Cu | Error | | | | | | |
| | | | | | Ni | Error | | | | | | |

ZrTiBeCuNi—(0.10% dissolved)
316L SS—(<0.10%% dissolved)
Ti64—(0.20% dissolved)
CoCrMo—(0.10% dissolved)

Corrosion in 37% HCl:

$Zr_{67}Ti_{19}Be_4Cu_{11}Ni_{10}$—dissolved in under 5 minutes
$Zr_{61}Ti_{27}Be_5Co_7$—1 week (100% dissolved)
$Zr_{65}Ti_{29}Be_6$—1 week (10% dissolved), 1 month (100% dissolved)
$Fe_{62}Cr_{18}Ni_{15}Mo_3Mn_2$—1 week (100% dissolved)
$Ti_{90}Al_6V_4$—1 week (100% dissolved)
$Co_{65}Cr_{29}Mo_6$—1 week (1% dissolved), 1 month (10% dissolved)

In short, these results again provide support for the idea that in Zr—Ti—Be-LTM BMGs corrosion resistance increases in relation to the following inequality between LTMs: Cu<Ni<Co<Cr<Fe<none. They also provide striking evidence that the alloys of the current invention have corrosion resistance properties far superior not only to conventional BMGs, but also to Ti alloys and stainless steel. Moreover, the Zr—Ti-based alloys of the current invention also show corrosion resistance on par with CoCrMo, which is considered by many to be the gold standard of corrosion resistant metal alloys.

Example 2

Biological Application of the Inventive Materials

As previously discussed, the elimination of cytotoxic elements like Ni and Cu opens up the possibility that the inventive BMG materials could be used in biological applications such as in medical implants and instruments, such as, for example, medical implants including load-bearing and non-load-bearing implants. (Yamamoto et. al. J Biomed Mater Res, 39, 331-340, (1998), the disclosure of which is incorporated herein by reference.)

In the simplest approximation, cytotoxicity can be thought of as a corrosion problem. (Burke, G. L., Can. Med. Assoc. J. August, 125 (1940), the disclosure of which is incorporated herein by reference.) As discussed in the previous section the Zr—Ti-based BMGs of the current invention exhibit excellent corrosion resistance in environments far more corrosive than those to be found in the human body. For example in the corrosion resistance tests described above 12 Molar HCl, 15.8 Molar $HNO_3$, and 19 Molar NaOH were used. In terms of determining biocompatibility these tests are clearly an extreme worst-case scenario.

For example, 0.6M NaCl simulates ocean water and is four times the NaCl content of human blood. PBS is isotonic with human blood so 10×PBS has an order of magnitude more salt than human blood. Likewise, in comparison stomach acid is 1200 times less acidic than the HCl used, milk of magnesia is 7300 times less alkaline than the NaOH solution used, and both of the tested substances are seven orders of magnitude more corrosive than human saliva. In short, the ability of the inventive BMG materials to withstand the corrosive effects of the HCl and NaOH solutions tested provides a conclusive evidence that the materials are robust enough to survive undegraded if implanted into the human body.

Beyond the improved corrosion resistance discussed above, an additional reason for the interest in trying to adopt BMGs for use in biological, and particularly load-bearing medical implant applications, relates to the mechanical properties of these materials. Specifically, although a number of excellent crystalline alloys are used for load-bearing implants, such as, for example, T164, 316L stainless steel and CoCrMo. Although substantial research was devoted to optimize the microstructure and improve the mechanical properties of these materials, they are still far from ideal in terms of biomechanical compatibility, for reasons mostly related to the limitations imposed by their crystalline atomic structure.

Figure 9A:
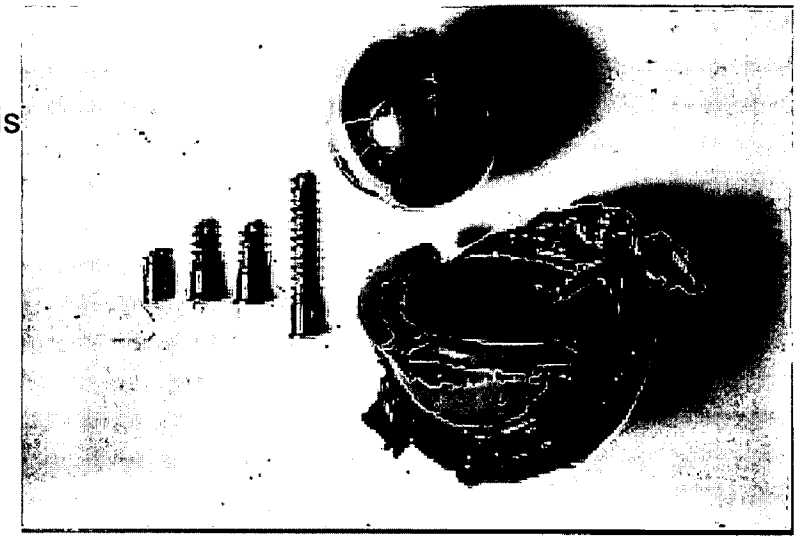
FIGS. 9*a* to 9*c* provide photographs of common implant failures.
Figure 9B:
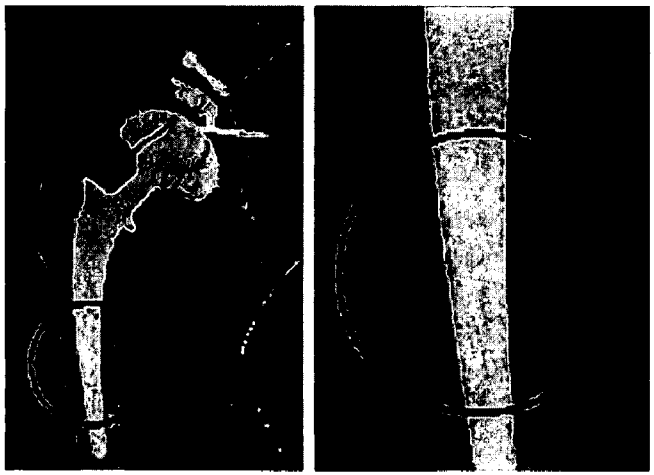
Figure 9C:
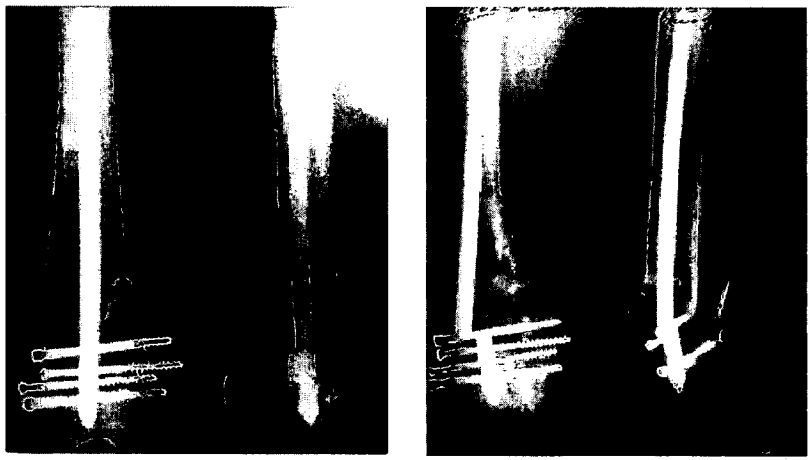

Load-bearing implants with inadequate mechanical properties suffer from early wear, fracture, or fatigue, all of which lead to ultimate failure of the implant. Moreover, implants with inadequate properties may cause adverse biological reactions on the natural tissue adjacent to the implant, which may ultimately lead to implant failure. Some common problems associated with current implant materials are shown in the photographs provided in FIG. 9. For example, one common implant failure is caused by wear debris, which occurs between moving artificial joints. FIG. 9*a* shows a worn acetabular cup for illustration. Production of wear debris, which arises due to insufficient hardness or toughness of the implant material, can cause inflammation in the surrounding tissue and eventual implant rejection. In addition, many conventional implant materials have stiffness much higher than that of bone, and consequently they support more load than the surrounding bone causing the bone to atrophy and the implant to loosen, as shown in FIG. 9*b*. This effect is commonly referred to as stress shielding. Finally, cyclic loading especially in overweight individuals can cause fatigue failure in implants at stresses much lower than the yield strength. An example of fatigue failure is shown in a femoral nail in FIG. 9*c*. On the Left is an x-ray after implantation and on the right is an x-ray after failure.

As previously discussed, owing to their amorphous atomic structure, Zr—Ti-based BMGs have a number of mechanical advantages over biometals currently employed as load-bearing implants, including two times the strength, two times the hardness and less than half the stiffness. Moreover, these materials have ten times the elastic limit of crystalline metals, such that the elasticity of the implant material should more closely match the characteristic elasticity of bone, as shown in FIG. 10. Although these BMG materials have not been comprehensively tested to determine whether or not their improved mechanical properties will survive exposure to the corrosive environment of the body, the improved hardness, strength and elasticity of the inventive BMGs provide promise for improving biomechanical compatibility between bone and implant and in turn reducing the occurrence of failure.

Lastly, an additional motivation to adopt amorphous metals in medical implant applications is the advantages in fabrication technology they can offer. As mentioned earlier, the amorphous atomic structure of Zr—Ti-based BMGs exhibit net-shape forming and micro-forming capabilities superior to those of conventional crystalline metals. Presently, the fabrication of medical devises and implants from feedstock material of crystalline biometals requires complex procedures which contribute to raise cost and often result in final product properties that are inferior to the properties of the feedstock. Fabrication methods include investment casting, conventional and computer-based machining (CAD/CAM), forging, powder metallurgical processes, and a range of grinding and polishing steps. Another aspect of fabrication involves the application of macro- or micro-porous coating on implants, or the deliberate production of certain degrees of surface roughness. The most commonly employed surface treatment is high-temperature sintering, however treatments such as plasma or flame spraying, ion implantation, nitriding, and coating with a thin diamond film are also employed. In addition to being highly complex, many of these procedures (e.g. powder metallurgy or thermal spray coating) often yield products whose mechanical properties are inferior to those of the bulk monolithic material. The net-shape forming and micro-forming capabilities of Zr—Ti-based BMGs open the possibility of introducing simpler and more cost efficient fabrication routes which could potentially improve part quality and reduce fabrication costs.

To determine whether the BMGs of the current invention might be suitable for use in biological applications, tests were conducted to determine the biocompatibility of exemplary materials. Specifically, two exemplary materials, $Zr_{61}Ti_{27}Be_5Co_7$ and $Zr_{65}Ti_{29}Be_6$, were both tested for cytotoxicity and biocompatibility through a short-term implantation study. Standard NAMSA study protocols were used for these studies. Specifically, an NAMSA ISO 10993-5 short-term cytotoxicity study was conducted on the two alloys and a NAMSA ISO 10993-6 short-term implantation study was conducted on the two. The alloys passed both studies indicating a lack of cytotoxicity and appropriate implantation on the time scales used in the tests. The full details of the studies are attached as Appendix A to this application.

In summary, the inventive Cu/Ni-free Zr—Ti-based BMGs demonstrate superior mechanical properties and advanced fabrication capabilities while at least matching the corrosion resistance properties of conventional crystalline implant materials. In addition, initial tests on the bioactivity, cytotoxicity and biocompatibility of these materials all indicate no adverse reactions. Accordingly, it is submitted that the inventive materials could be well-suited for use in biological application, such as, for example, medical implants and instruments, and the invention is also directed to medical instruments and conventional implants, particularly load-bearing implants, such as, for example, orthepaedic, dental, spinal, thoracic, cranial implants made using the inventive alloys. It should be understood that while the above discussion has focused on issues associated with load-bearing medical implants that the materials may be used for any biological application including non-load-bearing implants and medical instruments.

CONCLUSION

In summary, the current invention is directed to Zr—Ti-based bulk metallic glass compositions having improved corrosion resistance properties. The two basic principles are: (1) elimination of highly electronegative elements (<1.90); and (2) the provision of a sufficient mix of less electronegative additives such as, for example, Be, Co, Fe, Cr, etc to ensure conservation of the material's amorphous character.

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A bulk metallic glass having a high corrosion resistance comprising a composition including at least Zr, Ti, Be and an additive X wherein X is an additive material selected from the group consisting of Y, Co, Fe, Cr, Mo, Mg, Al, Hf, Ta, Nb and V;

wherein in the composition the sum of Zr and Ti is at least around 60 at %;

wherein in the composition the sum of Be and X is from around 25 to 40 at %, wherein Be is at least around 25 at %, and X is at least around 2 at %;

wherein elements having an electronegativity of at least 1.9 are present only in trace amounts; and wherein the bulk metallic glass demonstrates a lower corrosion rate than conventional ZrTiBe amorphous alloys having at least 2.5 at % Cu or Ni in a test wherein a plurality of tested samples having an identical starting shape and volume are immersed in a 37% HCl solution for 72 hours.

2. The bulk metallic glass of claim 1, wherein the ratio of Zr to Ti is around 1.16.

3. The bulk metallic glass of claim 1, wherein the concentration of X is from around 2 to 7.5 at %.

4. The bulk metallic glass of claim 1, wherein the concentration of Zr is around 35 at % and the concentration of Ti is around 30 at %.

5. The bulk metallic glass of claim 1, wherein the concentration of Be is from around 27.5 to 33 at %.

6. The bulk metallic glass of claim 1, wherein the alloy has a composition selected from the group consisting of $Zr_{25}Ti_{40}Be_{30}Cr_5$, $Zr_{35}Ti_{30}Be_{33}Fe_2$, $Zr_{35}Ti_{30}Be_{31}Fe_4$, $Zr_{35}Ti_{30}Be_{29}Fe_6$, $Zr_{35}Ti_{30}Be_{27.5}Fe_{7.5}$, $Zr_{35}Ti_{30}Be_{33}Co_2$, $Zr_{35}Ti_{30}Be_{31}Co_4$, $Zr_{35}Ti_{30}Be_{29}Co_6$, and $Zr_{35}Ti_{30}Be_{27.5}Co_{7.5}$.

7. The bulk metallic glass of claim 1, wherein the alloy has an amorphous phase comprising at least around 25% of the alloy by volume.

8. The bulk metallic glass of claim 1, wherein the alloy shows substantially no evidence of mass loss after a 3 month exposure to a solution of 0.6M NaCl.

9. The bulk metallic glass of claim 1, wherein the alloy shows substantially no evidence of mass loss after a 3 month exposure to a solution of 10× PBS.

10. The bulk metallic glass of claim 1, wherein the alloy shows substantially no evidence of mass loss after a 3 month exposure to a solution of 50% NaOH.

11. The bulk metallic glass of claim 1, wherein the alloy shows substantially no evidence of mass loss after a 1 month exposure to a solution of 50% NaOH.

12. The bulk metallic glass of claim 1, wherein the alloy shows a mass loss equal to or less than around 0.1% after a 3 month exposure to a solution of 50% NaOH.

13. The bulk metallic glass of claim 1, wherein the alloy shows a mass loss equal to or less than around 0.2% after a 24 hour exposure to a solution of 37% HCl.

14. The bulk metallic glass of claim 1, wherein the alloy shows a mass loss equal to or less than around 10% after a 1 week exposure to a solution of 37% HCl.

15. The bulk metallic glass of claim 1, wherein the alloy is biocompatible.

16. A medical implant comprising:

an implant body formed of a bulk metallic glass having a composition including at least Zr, Ti, Be and an additive X:

wherein X is an additive material selected from the group consisting of Y, Co, Fe, Cr, Mo, Mg, Al, Hf, Ta, Nb and V;

wherein in the composition the sum of Zr and Ti is at least around 60 at %;

wherein in the composition the sum of Be and X is from around 25 to 40 at %, wherein Be is at least around 25 at %, and X is at least around 2 at %;

wherein elements having an electronegativity greater than of at least 1.9 are present only in trace amounts; and wherein the bulk metallic glass demonstrates a lower corrosion rate than conventional ZrTiBe amorphous alloys having at least 2.5 at % Cu or Ni in a test wherein a plurality of tested samples having an identical starting shape and volume are immersed in a 37% HCl solution for 72 hours.

17. The implant of claim 16, wherein the ratio of Zr to Ti is around 1.16.

18. The implant of claim 16, wherein the concentration of X is from around 2 to 7.5 at %.

19. The implant of claim 16, wherein the concentration of Zr is around 35 at % and the concentration of Ti is around 30 at %.

20. The implant of claim 16, wherein the concentration of Be is from around 27.5 to 33 at %.

21. The implant of claim 19, wherein the alloy has a composition selected from the group consisting of $Zr_{25}Ti_{40}Be_{30}Cr_5$, $Zr_{35}Ti_{30}Be_{33}Fe_2$, $Zr_{35}Ti_{30}Be_{31}Fe_4$, $Zr_{35}Ti_{30}Be_{29}Fe_6$, $Zr_{35}Ti_{30}Be_{27.5}Fe_{7.5}$, $Zr_{35}Ti_{30}Be_{33}Co_2$, $Zr_{35}Ti_{30}Be_{31}Co_4$, $Zr_{35}Ti_{30}Be_{29}Co_6$, and $Zr_{35}Ti_{30}Be_{27.5}Co_{7.5}$.

22. The implant of claim 16, wherein the implant is net-shape formed.

23. The implant of claim 16, wherein the implant is micro-formed.

* * * * *